United States Patent [19]

West

[11] Patent Number: 4,523,264

[45] Date of Patent: Jun. 11, 1985

[54] TWO-PIECE TUBE SUPPORT ASSEMBLY

[75] Inventor: Gordon M. West, Miami, Fla.

[73] Assignee: West & Associates, Inc., Miami, Fla.

[21] Appl. No.: 569,446

[22] Filed: Jan. 9, 1984

[51] Int. Cl.[3] ..... F21V 21/00

[52] U.S. Cl. ..... 362/396; 362/217; 362/382; 362/417; 362/431

[58] Field of Search ..... 362/382, 396, 217, 417, 362/431

[56] References Cited

U.S. PATENT DOCUMENTS

| | | | |
|---|---|---|---|
| 2,885,538 | 5/1959 | Mahon et al. | 362/396 |
| 3,868,182 | 2/1975 | Kidd | 362/217 |
| 4,337,503 | 6/1982 | Turner | 362/396 |
| 4,390,927 | 6/1983 | Von Feldt | 362/396 X |
| 4,447,861 | 5/1984 | Hetzel et al. | 362/396 X |

*Primary Examiner*—Stephen J. Lechert, Jr.
*Attorney, Agent, or Firm*—Wegner & Bretschneider

[57] ABSTRACT

This invention relates to supports for cylindrical tubes, in particular the glass tubes used as the envelopes for fluorescent or other gas-filled lamps. The invention has particular applicability to the support of neon sign tubes.

1 Claim, 2 Drawing Figures

FIG. 1
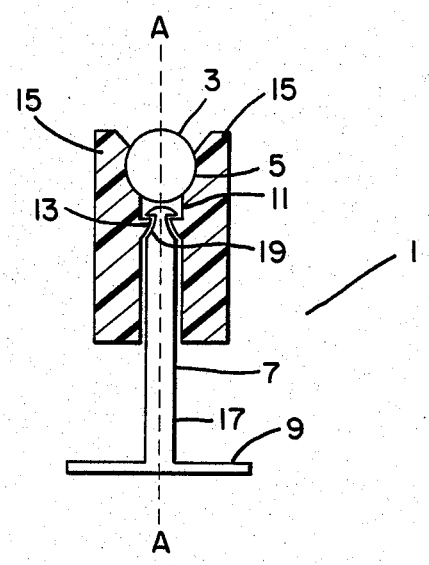
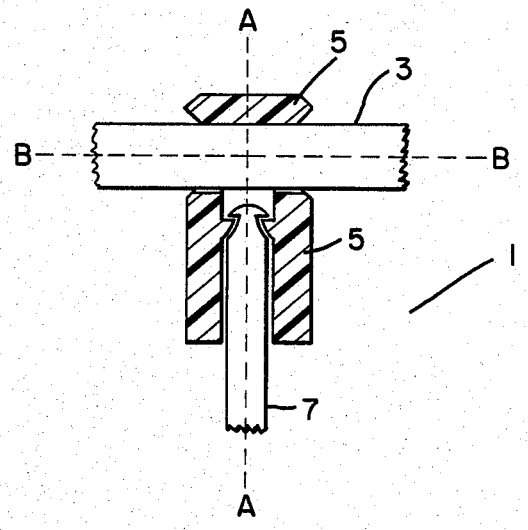
FIG. 2

TWO-PIECE TUBE SUPPORT ASSEMBLY

BACKGROUND OF THE INVENTION

Prior art neon tubing supports, such as that disclosed in U.S. Pat. No. 2,885,538, have achieved considerable acceptance in the marketplace. However, they present disadvantages when used with the 15 mil. tube employed in fabricating small channel neon tubing letters where it is sometimes difficult for hands to reach. In particular, there has been a need in the art for a low cost support can be readily employed without adjustment to support tubing of the commonly used sizes by using a tube holder of a size chosen to fit the tubing to be installed, which then can be snapped into a base.

More recent innovations in the area, such as those reflected in U.S. Pat. Nos. 3,868,182 and 4,337,503, while providing for tube holders which are specifically designed for the particular size of tube involved, do not provide the ease of installation and removal, without the need of special tools, that is desired by persons who must install neon signs, for example.

BRIEF DESCRIPTION OF THE DRAWING

FIG. 1 is a cross sectional view of an assembled two-piece assembly in accordance with this invention, with a neon sign tube placed therein.

FIG. 2 is a cross sectional view of the assembly of FIG. 1 taken through axis A—A at right angles to the view shown in FIG. 1.

DESCRIPTION OF THE INVENTION

The two-piece assembly in accordance with this invention is depicted on the attached drawings. The two-piece assembly 1 is shown in cross section with a tube 3 affixed therein. This tube may be a neon tube, a fluorescent tube, or other similar tube, be it of glass, plastic, metal or the like. The nature of the tube to be held is not a part of the invention. The assembled device in accordance with this invention is designed to be affixed to a support surface, such as a sign or the like, although the nature of the surface to which the device is affixed is not a critical part of the invention, and the shape of the support shown may be altered to suit the particular installation.

The two-piece assembly in accordance with this invention comprises a tube holder 5 snapped into a support 7 which, as shown in FIG. 1, may be formed with a base 9. The base 9 is omitted from the view in FIG. 2.

The tube holder 5 is formed of a resilient material, preferably a thermoplastic polyester. Tube holder 5 is shown in the drawings as being shaded for plastic, although cylindrical support 7 is not so lined for reasons of clarity of drawing, although it is preferably formed of the same material. The tube holder has a substantially cylindrical body having a hole formed along its longitudinal axis, as shown by dotted line A—A. In the wall of the hole is formed a recess 11, either by forming an annular notch in the wall of the hole along axis A—A or by providing a projection 13 as shown in FIGS. 1 and 2. For the purpose of this application, these alternate embodiments are both referred to as "an annular recess". The portion of the tube holder which holds tube 3 is formed by projections 15 integral with cylindrical body 5 which form a bore between the projections which is substantially circular in cross section (corresponding to the tube to be held), and having its longitudinal axis B—B (shown in FIG. 2) substantially perpendicular to the longitudinal axis A—A of the cylindrical body 5. The tube fits within the bore between projections 15 in a resilient snap fit, firmly securing the tube while allowing for ready removal and replacement thereof.

The support 7 comprises a base 9 and a cylindrical support member 17 formed integrally with the base. On the end of the cylindrical support member 17 distal from the base, there is formed an annular projection 19 which is so designed as to mate with the annular recess 11 in the tube holder when the holder and support are pressed together, again in a snap fit. The embodiment shown in FIGS. 1 and 2 shows a notch 19 which is designed so as to engage projection 13 in the hole along longitudinal axis A—A of the tube holder.

It is understood that modifications may be made in the structure disclosed without departing from the spirit and intent of the invention, as more fully set forth in the following claim.

I claim:

1. A two-piece assembly for use in holding a tube, comprising a tube holder and support, said tube holder being formed of a resilient plastic and comprising a substantially cylindrical body having a hole formed along the longitudinal axis thereof, said hole having formed in the wall thereof an annular recess, and projections integral with said cylindrical body forming a bore between them substantially circular in cross section and corresponding to the tube to be held, having its longitudinal axis substantially perpendicular to the longitudinal axis of the cylindrical body; and said support comprising a base and a cylindrical support member formed integrally thereon, the end of the support member distal from the base having formed therein an annular projection which mates with the annular recess in the holder when the holder and support are pressed together.

* * * * *